US005895173A

United States Patent [19]

O'Brien et al.

[11] Patent Number: 5,895,173

[45] Date of Patent: *Apr. 20, 1999

[54] ROADWAY PAVING APPARATUS

[75] Inventors: Patrick O'Brien; Thomas Brown, both of Oregon, Ill.

[73] Assignee: E. D. Etnyre & Co., Oregon, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/901,586

[22] Filed: Jul. 28, 1997

Related U.S. Application Data

[62] Division of application No. 08/592,584, Jul. 26, 1996.

[51] Int. Cl.[6] ..... E01C 19/12

[52] U.S. Cl. ..... 404/108; 404/110; 404/111

[58] Field of Search ..... 404/75, 82, 92, 404/101, 108, 110, 111

[56] References Cited

U.S. PATENT DOCUMENTS

| | | | |
|---|---|---|---|
| 1,158,503 | 11/1915 | Johnston . | |
| 1,242,558 | 10/1917 | Johnston . | |
| 1,912,897 | 6/1933 | Huet . | |
| 3,902,666 | 9/1975 | Ito et al. | 239/130 |
| 4,315,700 | 2/1982 | Heiligtag et al. . | |
| 4,529,622 | 7/1985 | Maxfield | 427/136 |
| 4,678,363 | 7/1987 | Sterner | 405/75 |
| 4,856,931 | 8/1989 | Bollag | 404/75 |
| 4,948,431 | 8/1990 | Strickland et al. . | |
| 4,974,993 | 12/1990 | Crabbi . | |
| 5,039,557 | 8/1991 | White . | |
| 5,069,578 | 12/1991 | Bense et al. . | |
| 5,079,095 | 1/1992 | Reed et al. | 428/489 |
| 5,153,026 | 10/1992 | Reed et al. | 427/138 |
| 5,178,486 | 1/1993 | Perrin et al. . | |
| 5,279,500 | 1/1994 | Perrin et al. . | |
| 5,405,440 | 4/1995 | Green et al. . | |
| 5,439,313 | 8/1995 | Blaha et al. | 404/75 |
| 5,544,972 | 8/1996 | Boldt . | |

FOREIGN PATENT DOCUMENTS

| | | | |
|---|---|---|---|
| 0/478441 A1 | 4/1992 | European Pat. Off. | E01C 19/48 |

*Primary Examiner*—James A. Lisehora
*Attorney, Agent, or Firm*—Leydig, Voit & Mayer, Ltd.

[57] ABSTRACT

A roadway paving apparatus applies successive layers of paving material to a roadway surface so as to form a desired thickness of pavement thereon. Preferably, the apparatus comprises a hopper for hauling aggregate material (e.g., gravel, sand, and/or crushed stone) and for dispensing a curtain of falling aggregate material therefrom. An initial group of spray nozzles aimed generally at the surface of the roadway applies a base layer of adhesive material (e.g., liquid asphalt) to the surface of the roadway. One or more groups of subsequent spray nozzles aimed generally at the curtain of falling aggregate material coats the curtain of falling aggregate material with adhesive material such that an intermediate layer of adhesive coated aggregate material is deposited on top of the underlying base layer of adhesive material. A final group of spray nozzles aimed at the surface of the roadway applies an overspray layer of adhesive material on top of the intermediate layer of adhesive coated aggregate material. A corresponding method of paving a roadway surface by applying successive layers of paving material the surface is also provided.

18 Claims, 1 Drawing Sheet

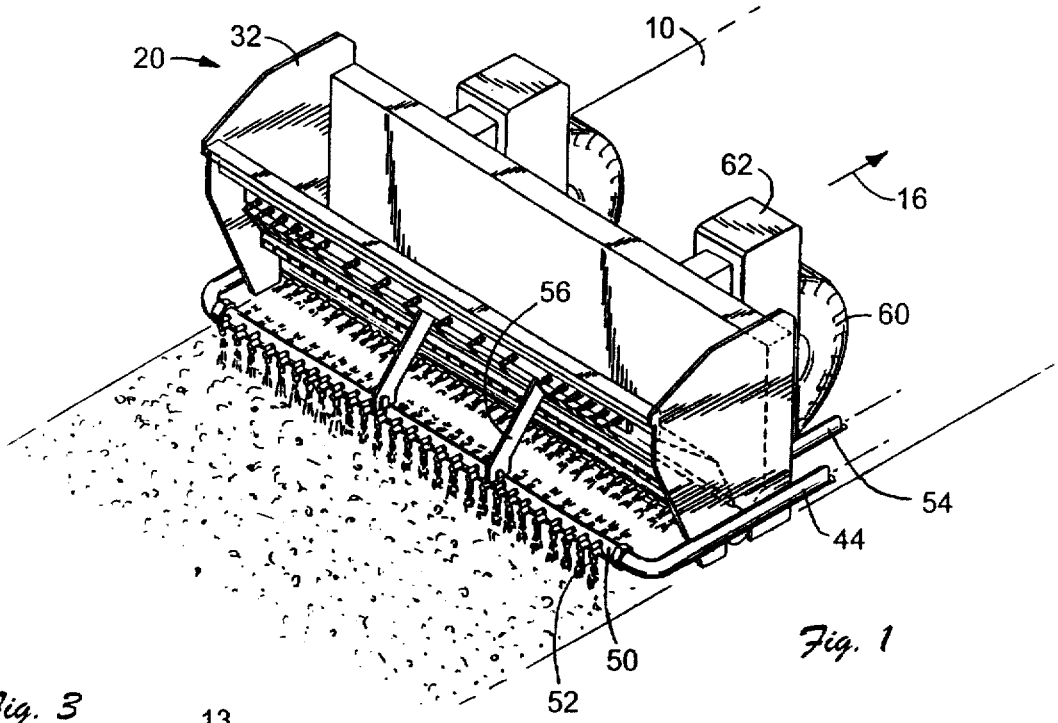
Fig. 1
Fig. 3
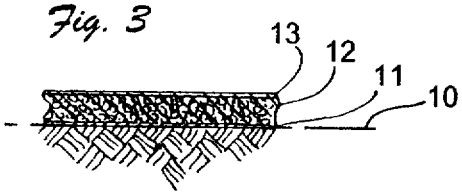
Fig. 2
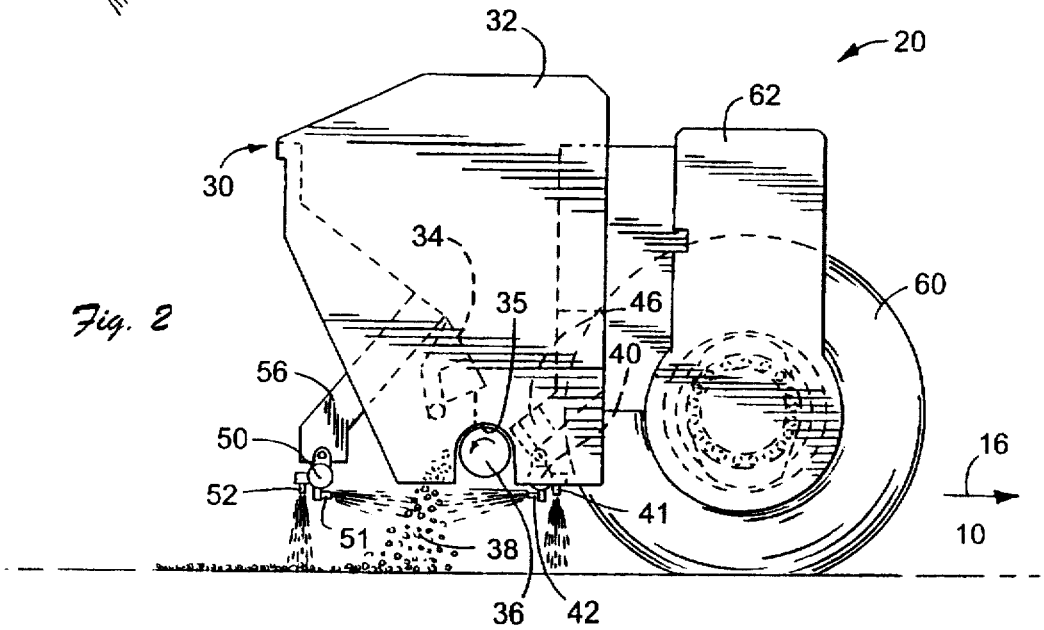

ROADWAY PAVING APPARATUS

RELATED APPLICATIONS

This application is a divisional of co-pending U.S. application Ser. No. 08/592,584, filed Jan. 26, 1996.

TECHNICAL FIELD OF THE INVENTION

The present invention relates generally the surfacing and resurfacing of roadways and, more particularly, to an apparatus for applying successive layers of paving material to a surface so as to form a desired thickness of pavement thereon.

BACKGROUND OF THE INVENTION

In order to provide a more durable surface for vehicular traffic, modern roadways are usually paved. In the construction of new roadways, pavement is typically applied to an unpaved base after it has been graded and compacted (i.e., the new roadway is surfaced). In the repair of existing roadways, however, pavement is typically applied to the surface of the existing roadway (i.e., the existing roadway is resurfaced).

Over time, existing roadways inevitably become worn and in need of repair. For example, cracks may develop in the surface and/or the surface may become overly smooth. In either event, the existing roadway surface becomes dangerous to drive on and, thus, presents a public safety concern. If cracks develop, the surface will no longer be water resistant, and the roadway will deteriorate at an accelerated pace. If, on the other hand, the surface becomes overly smooth, the skid resistance of the roadway will be adversely effected. As such, existing roadways should be periodically resurfaced (or repaved) in the course of proper maintenance.

Depending on the application of the roadway, pavements may either be of flexible or rigid construction. Rigid pavements are typically formed of concrete, or the like, while flexible pavements typically comprise a combination of aggregate material (e.g., gravel, sand, crushed stone, etc.) and adhesive material (e.g., liquid asphalt, emulsified asphalt, molten bituminous material, binder material, etc.).

A common process for paving a roadway with flexible pavement is known as "chipsealing". In chipsealing, loose aggregate material is dropped into a previously applied layer of adhesive material which binds the aggregate material to a surface (e.g., the unpaved base of a new roadway or the surface of an existing roadway). In practice, chipsealing utilizes an asphalt distributor and a chipspreader. The asphalt distributor is used to apply an initial layer of adhesive material to the surface, and, once the adhesive material is in place, the chipspreader is then used to distribute aggregate material on top of the initial layer of adhesive material. Thus, in practice, chipsealing is performed by two separate machines making two separate passes over the same portion of the roadway in order to apply a single layer of pavement to that portion.

By and large, chipsealing is a relatively fast and inexpensive technique for surfacing or resurfacing a roadway. However, presently-employed chipsealing processes have several noted deficiencies. First, two separate machines are required (i.e., an asphalt distributor and a chipspreader). Second, two separate passes over the same portion of roadway is needed to complete each layer of the paving operation (i.e., an initial pass by the asphalt distributor and a subsequent pass by the chipspreader). Third, since the loose aggregate material must submerse into the previously applied layer of adhesive material in order to properly bond therewith, the maximum thickness of each pavement layer is limited to the size of the largest individual piece of aggregate material (e.g., the largest stone). As a result, only relatively thin layers of pavement may be formed, and, if a greater thickness is desired, additional layers of pavement must thereafter be applied.

In addition to the shortcomings noted above, it is also found that presently-employed chipsealing processes often leave loose particles of aggregate material on the freshly paved roadway surface. More particularly, it has been found that many particles of aggregate material do not sufficiently submerse into the underlying adhesive material or bond therewith. This is particularly true for top level particles. In addition, other particles weakly bond with the adhesive material, and as a result, are often dislodged when vehicles drive over the roadway. Loose aggregate material also gives the freshly paved roadway surface a peculiar non-black appearance.

SUMMARY OF THE INVENTION

Accordingly, a primary object of the present invention is to provide an improved roadway paving apparatus and method that overcomes the above-identified deficiencies in presently-employed chipsealing processes.

A more specific object of the present invention is to provide an apparatus and method for paving roadways that allows a single device to apply a desired thickness of pavement to a surface in a single pass.

A related object of the present invention is to provide an apparatus and method for paving roadways that allows a single device to apply a relatively thick layer of pavement to the unpaved base of a new roadway in a single pass.

A further related object of the present invention is to provide an apparatus and method for paving roadways that allows a single device to apply a relatively thick layer of pavement to the surface of an existing roadway in a single pass.

Another object of the present invention is to provide an apparatus and method for surfacing or resurfacing roadways that effectively bonds aggregate material to a surface.

An additional object of the present invention is to provide an apparatus and method for surfacing or resurfacing roadways that minimizes the presence of loose aggregate material on the top level of a freshly paved roadway surface.

A further object of the present invention is to provide an apparatus and method for surfacing and resurfacing roadways with pavement having a uniform black color.

Still another object of the present invention is to provide an apparatus and method for paving, surfacing, and/or resurfacing roadways that realizes substantial cost efficiencies over presently-employed processes.

In accordance with these and other objects, a roadway paving apparatus which applies successive layers of paving material to a surface in order to form a desired thickness of pavement thereon is provided. In keeping with the present invention, the surface may either be the unpaved base of a new roadway or the surface of an existing roadway. In addition, a method of applying successive layers of paving material to a surface in order to form a desired thickness of pavement thereon is also provided. The apparatus of the present invention, in particular, comprises a hopper for hauling aggregate material (e.g., gravel, sand, crushed stone, etc.) and for dispensing a curtain of falling aggregate material therefrom, an initial group of spray nozzles aimed generally at the surface for applying a base layer of adhesive material (e.g., liquid asphalt, emulsified asphalt, molten bituminous material, binder material, etc.) to the surface, a subsequent group of spray nozzles aimed generally at the falling curtain of aggregate material for coating the falling curtain of aggregate material with adhesive material such that an intermediate layer of adhesive coated aggregate material is deposited on top of the bonding layer of adhesive material, and a final group of spray nozzles aimed generally at the surface for applying an overspray layer of adhesive material to the intermediate layer of adhesive coated aggregate material.

BRIEF DESCRIPTION OF THE DRAWINGS

FIG. 1 is a perspective view of a roadway paving apparatus constructed in accordance with the present invention;

FIG. 2 is a side elevational view of the roadway paving apparatus depicted in FIG. 1; and FIG. 3 is diagrammatic view of a surface, shown in partial cross-section, after it has been paved by the apparatus of the present invention.

While the present invention will be described and disclosed in connection with certain preferred embodiments, the intent is not to limit the present invention to these specific embodiments. On the contrary, the intent is to cover all such alternatives, modifications, and equivalents that fall within the spirit and scope of the present invention as defined by the appended claims.

DETAILED DESCRIPTION OF THE PREFERRED EMBODIMENT

Turning now to the drawings, a roadway paving apparatus constructed in accordance with the teachings of the present invention is generally designated by reference numeral 20.

As best shown in FIGS. 1 and 2, the roadway paving apparatus 20 broadly comprises a hopper 30 for hauling and dispensing aggregate material (e.g., gravel, sand, crushed stone, etc.), and a plurality of spray nozzles 41, 42, 51, and 52 for discharging adhesive material (e.g., liquid asphalt, emulsified asphalt, molten bituminous material, binder material, etc.). In accordance with certain aspects of the present invention, the adhesive material should be of a type that solidifies after application.

In operation, the roadway paving apparatus 20 either forms a part of a self-propelled carrier vehicle (not shown), or is towed by a separate vehicle (also not shown). In either event, the roadway paving apparatus 20 is moved in a direction generally indicated by reference numeral 16.

While in motion, the roadway paving apparatus 20 mixes and applies successive layers of paving material to a surface 10. It will be appreciated by those skilled in the art, of course, that the roadway paving apparatus 20 is capable of either surfacing a new roadway or resurfacing an existing roadway. In other words, the surface 10 described and illustrated herein not only includes the unpaved base of a new roadway, but also includes the surface of an existing roadway. In addition, the surface 10 of an existing roadway may either be rigid or flexible in construction. In any event, the paving material furnished by the apparatus 20 of the present invention not only improves the skid resistance of the surface 10, but also seals against moisture.

As diagrammatically depicted in FIG. 3 of the drawings, the roadway paving apparatus 20 of the present invention preferably applies a total of three successive layers of paving material to the surface 10. In particular, a base (or bottom) layer 11 of adhesive material is applied to the surface 10. In application, the adhesive material of the bottom layer 11 not only seals the surface 10, but also provides a bonding or base layer for subsequent layers of paving material. Next, an intermediate (or middle) layer 12 of adhesive coated aggregate material is deposited on top of the bottom layer 11 of adhesive material. As illustrated in FIG. 3, and as will be described in more detail below, the middle layer 12 is a amalgamation of aggregate material and adhesive material. Finally, an upper (or top) layer 13 of adhesive material is deposited on top of the intermediate layer 12 of adhesive coated aggregate material. In use, the adhesive material of the third layer 13 ensures that virtually no aggregate material is either loosely scattered on the new roadway surface or easily dislodged therefrom. The adhesive material of the third layer 13 also provides a uniform black color to the new surface of the roadway.

Although FIG. 3 diagrammatically depicts the bottom, middle, and top layers 11, 12, and 13 of paving material as being three independent layers, it will be understood by those skilled in the art that once these layers have been deposited by the paving apparatus 20, they become indistinguishable from one another (i.e., there is no distinct boundary between the three layers). Put another way, the three layers 11, 12, and 13 form a single stratum (or amalgam) of paving material. Furthermore, in practice, the middle layer 12 of adhesive coated aggregate material forms the thickness of the pavement. As such, FIG. 3 merely illustrates the order in which the three individual layers of paving material 11, 12, and 13 are deposited on to the surface 10, and should not be construed as an actual cross-sectional representation of the surface 10 after it has been surfaced (or resurfaced) by the roadway paving apparatus 20 of the present invention. Indeed, upon reading the present disclosure it will be appreciated by those skilled in the art that while it is convenient to consider the apparatus in terms of layers or groups of nozzles, the important features are the application of binder layer which will bind the material to the surface being paved, application of a layer comprising a curtain of coated aggregate material and, if desired, application of a final or finish layer of binder material. The nozzles, which apply the binder material are described as being in groups, and are conveniently configured as groups in manifolds, but the important feature, of course, is not the not so much the grouping of nozzles as the fact that they apply the layers to the surface and to the falling curtain as described in detail herein.

The hopper 30 of the present invention, as most clearly shown in FIG. 2, includes an open top portion 32, and a discharge chute 34 with an outlet 35. In operation, as the roadway paving apparatus 20 is moved in the direction indicated by reference numeral 16, a curtain of falling aggregate material 38 is dispensed from the outlet 35 of the discharge chute 34. Preferably, the aggregate material comprises crushed stone, or the like, but may also comprise gravel, sand, and/or other forms like materials. In order to provide a substantially uniform curtain of falling aggregate material 38, the hopper 30 includes a rotatable spread roll 36 disposed between the discharge chute 34 and the surface 10. In addition, a conveyor system (not shown), or the like, may be used to conveniently provide the top portion 32 of the hopper 30 with a supply of aggregate material.

In the illustrated embodiment of the present invention, four groups (or sets) of spray nozzles—designated by reference numerals 41, 42, 51, and 52, respectively—are disposed laterally across the apparatus 20 for dispensing adhesive material. Preferably, the adhesive material comprises some form of liquid asphalt (e.g., molten asphalt or emulsified asphalt), but may alternatively comprise other forms of liquid bituminous material, or the like. As best shown in FIG. 2, the two exterior sets of spray nozzles (i.e., sets 41 and 52) are aimed approximately vertically downwardly at the surface 10, while the two interior sets of spray nozzles (i.e., sets 42 and 51) are aimed approximately horizontally. Preferably, the two interior sets of spray nozzles (i.e., sets 42 and 51) are also aimed at opposite sides of the falling curtain of aggregate material 38. In use, the first exterior set of spray nozzles (i.e., set 41) applies the bottom layer 11 of liquid asphalt, while the second exterior set of spray nozzles (i.e., set 52) applies the top layer 13 of liquid asphalt. The two interior sets of spray nozzles (i.e., sets 42 and 51), on the other hand, collectively provide the asphalt for the middle layer 12 of asphalt coated aggregate material. That is, the two interior sets of spray nozzles (i.e., sets 42 and 51) coat the aggregate material as it is being dispensed on to the surface 10. Although two interior sets of spray nozzles (i.e., sets 42 and 51) are specifically described and illustrated herein, it will be appreciated by those skilled in the art that fewer or additional sets of interior nozzles may alternatively be used, provided that the curtain of falling aggregate material 38 is sufficiently coated with liquid asphalt prior to being deposited on the surface 10.

As best shown in FIGS. 1 and 2, the first and second sets of spray nozzles (i.e., sets 41 and 42) are carried by a first (or leading) spray bar 40, and the third and fourth sets of spray nozzles (i.e., sets 51 and 52) are carried by a second (or trailing) spray bar 50. In accordance with the present invention, the leading spray bar 40 is connected to a supply of adhesive material (not shown) by a first manifold 54, and the trailing spray bar 50 is connected to the same supply of adhesive material by a second manifold 44. As best shown in FIG. 2, the leading spray bar 40 is arranged toward the front of the hopper 30 (i.e., immediately upstream of the curtain of falling aggregate material 38), and the trailing spray bar 50 is arranged toward the rear of the hopper 30 (i.e., downstream of the curtain of falling aggregate material 38). In the illustrated embodiment, the leading spray bar 40 is mounted to the hopper 30 via a brace 46, and the trailing spray bar 50 is connected to the hopper 30 by outwardly projecting struts 56.

In order to facilitate the mobility of the roadway paving apparatus 20, a set of wheels 60 is also provided. As shown in FIG. 2, the wheels 60 are connected to the hopper via a fixture 62. The wheels 60 also serve to keep the hopper 30 sufficiently separated from the surface 10.

In use, as the roadway paving apparatus 20 is moved in the direction indicated by reference numeral 16, the four sets of spray nozzles 41, 42, 51, and 52 simultaneously dispense adhesive material, while the hopper 30 dispenses aggregate material, as shown in FIG. 2. In particular, the first set of spray nozzles 41 applies the bottom layer 11 of adhesive material to the surface 10. As most clearly shown in FIG. 2, the bottom layer 11 of adhesive material is applied immediately ahead of (or in front of) the curtain of falling aggregate material 38. The second and third sets of spray nozzles 42 and 51—operating concurrently with the first set of spray nozzles 41—simultaneously coat the curtain of falling aggregate material 38 with adhesive material such that the middle layer 12 of adhesive coated aggregate material is deposited on top of the bottom layer 11 of adhesive material, thereby enhancing the bond with the surface 10. In order to provide a more thorough coating, the second and third sets of spray nozzles 42 and 51 are preferably aimed at opposite sides of the curtain of falling aggregate material 38, as shown in FIG. 2. The fourth set of spray nozzles 52—operating concurrently with the first, second, and third sets of spray nozzles 41, 42, and 51—applies the top layer 13 of adhesive material to the middle layer 12 of adhesive coated aggregate material. In this way, the roadway paving apparatus 20 conveniently applies three successive layers 11, 12, and 13 of paving material (e.g., adhesive material, adhesive coated aggregate material, and adhesive material, respectively) to the surface 10 of the roadway in a single pass. Furthermore, once the three layers 11, 12, and 13 of paving material have been deposited on to the surface 10, they may be subsequently compressed or compacted by a compaction roller (not shown), or the like.

It will be apparent that the apparatus described above provides a mechanism for paving a surface by depositing successive layers of paving material thereon. The successive layers of paving material form the desired thickness of pavement. As such, the apparatus applies a pre-coating to the surface with an initial layer of adhesive material. Before the adhesive material has an opportunity to set up, and while it remains adhesive, a subsequent layer is applied. The subsequent layer comprises a mixture of aggregate material coated with adhesive material. The thus adhesive coated layer of aggregate material is deposited on the adhesive layer on the surface, and forms an amalgam therewith. Where desired, a finishing layer of adhesive material can be applied over the top to produce a solid black surface with a minimum of loose aggregate particles.

The roadway paving apparatus 20 of the present invention offers several key advantages over prior art devices and processes. First, presently-employed chipsealing processes, as discussed more fully above, require two separate passes in order to apply a single layer of pavement; namely, an initial pass with an asphalt distributor to spread asphalt on to the surface, and a subsequent pass (over the initial pass) with a chipspreader to distribute aggregate material on top of the asphalt. Second, the maximum thickness of a pavement layer is limited to the size of the largest individual piece of aggregate material (e.g., the largest stone). As a consequence, prior art devices and processes are only capable of applying a relatively thin layer of pavement to the surface with each pass of the asphalt distributor and chipspreader. Furthermore, if the first layer of pavement is not sufficiently thick, additional layers of pavement will have to be applied with subsequent passes by the asphalt distributor and the chipspreader. The roadway paving apparatus 20 of the present invention, in contrast, is capable of producing thicker layers of pavement than the devices of the prior art because the individual pieces of aggregate material do not have to submerse into a layer of previously applied adhesive material. Instead, the spray nozzles of the present invention (i.e., sets 42 and 51) advantageously coat the curtain of falling aggregate material 38 as it is dispensed from the hopper 30. Thus, unlike the devices of the prior art, the apparatus 20 of the present invention is able to apply a relatively thick layer of pavement (i.e., a layer of pavement that is thicker than the largest individual piece of aggregate material) to the surface 10, with only one machine making a single pass. As such, the apparatus 20 of the present invention is also usually able to apply a desired thickness of pavement to the surface 10 in a single pass.

What is claimed is:

1. An apparatus for applying successive layers of paving material to a surface so as to form a desired thickness of pavement thereon, the apparatus comprising, in combination:

a hopper for hauling aggregate material, the hopper including a discharge chute disposed to dispense a curtain of falling aggregate material therefrom;

first spray nozzles aimed generally at the surface for applying a bonding layer of asphalt binder material to the surface;

subsequent spray nozzles aimed generally at the falling curtain of aggregate material, the subsequent spray nozzles coating the curtain of falling aggregate material with asphalt binder material such that an intermediate layer of asphalt binder coated aggregate material is deposited on top of the bonding layer;

a leading spray bar carrying the first spray nozzles and a group of the subsequent spray nozzles, the leading spray bar connected to a source of asphalt binder material; and the apparatus being operated so that the falling curtain of aggregate material and subsequent spray nozzles deposit the intermediate layer of asphalt binder coated aggregate material on the bonding layer while the bonding layer is adhesive to form an amalgam of coated aggregate material bonded to the surface.

2. The apparatus according to claim 1, further including final spray nozzles aimed generally at the surface for applying an over spray layer of asphalt binder material over the intermediate layer, the over spray layer being applied while the intermediate layer remains adhesive so as to form an amalgam therewith.

3. The apparatus according to claim 2, wherein the apparatus has a given width across which the coatings and curtain of aggregate material are applied, wherein the final nozzles and the remainder of the subsequent nozzles are carried by a trailing spray bar.

4. The apparatus according to claim 3, wherein the leading spray bar is connected to the supply of asphalt binder material by a first manifold and the trailing spray bar is connected to the supply of asphalt binder material by a second manifold.

5. The apparatus according to claim 1, wherein the surface is an unpaved base.

6. The apparatus according to claim 1, wherein the surface is an existing roadway.

7. The apparatus according to claim 1, wherein the asphalt binder material is of a type that solidifies after being applied.

8. The apparatus according to claim 1, wherein the asphalt binder material comprises liquid asphalt.

9. The apparatus according to claim 8, wherein the asphalt binder material comprises molten asphalt.

10. The apparatus according to claim 8, wherein the asphalt binder material comprises emulsified asphalt.

11. The apparatus according to claim 8, wherein the asphalt binder material comprises liquid bituminous material.

12. The apparatus according to claim 1, wherein the aggregate material comprises crushed stone.

13. The apparatus according to claim 1, wherein the apparatus has a given width across which the coating and curtain of aggregate material are applied, the subsequent nozzles being arranged across the width of the apparatus, the apparatus further comprising a trailing spray bar carrying a remainder of the subsequent nozzles, the leading and trailing spray bars positioned on opposite sides of the falling curtain, the subsequent nozzles directed at the falling curtain from two sides thereof to thoroughly coat the falling curtain.

14. The apparatus according to claim 1, wherein the hopper further comprises a rotatable spread roll disposed substantially between the roadway and the discharge chute for providing a substantially uniform curtain of falling aggregate material.

15. The apparatus according to claim 1, wherein the hopper is connected to a set of wheels by a fixture.

16. The apparatus according to claim 1, wherein the apparatus includes means for attachment to a moving vehicle, whereby the apparatus may be towed behind the moving vehicle.

17. An apparatus for paving a surface of a roadway in a single pass by depositing successive layers of paving material thereon, the successive layers of paving material forming a desired thickness of pavement, the apparatus comprising, in combination:

a hopper for hauling aggregate material, the hopper including a discharge chute disposed to dispense a curtain of falling aggregate material therefrom;

first spray nozzles arranged upstream of the curtain of falling aggregate material and disposed to apply a base layer of liquid asphalt to the surface of the roadway ahead of the curtain of falling aggregate material, the liquid asphalt being of a type that solidifies after being applied;

subsequent spray nozzles directed generally at the curtain of falling aggregate material, the subsequent spray nozzles operative to coat the curtain of falling aggregate material with liquid asphalt such that an intermediate layer of asphalt coated aggregate material is deposited on top of the base layer of liquid asphalt;

a leading spray bar carrying the first spray nozzles and a group of the subsequent spray nozzles, a trailing spray bar carrying the remainder of the subsequent spray nozzles, the leading and trailing spray bar nozzles positioned so that the group of subsequent spray nozzles are directed at one side of the curtain while the remaining subsequent spray nozzles are directed at an opposite side of the curtain, the leading and trailing spray bars connected to a source of asphalt binder material; and the nozzles and curtain being positioned with respect to each other such that the curtain of coated aggregate material is applied to the base layer on the surface before said base layer solidifies so as to form an amalgam therewith.

18. The apparatus according to claim 17, including final spray nozzles attached to the trailing spray bar and disposed to apply an upper layer of liquid asphalt to the deposited intermediate layer of asphalt coated aggregate material, the final nozzles being positioned and operated to apply said upper layer before the asphalt in the intermediate layer solidifies to form an amalgam therewith.

* * * * *